US006471446B2

(12) United States Patent
Queen et al.

(10) Patent No.: US 6,471,446 B2
(45) Date of Patent: Oct. 29, 2002

(54) REDUCED SKIN FRICTION BORE CASING

(75) Inventors: Frankie A. R. Queen, Lawrenceville, GA (US); Jimmy Don Sailors, Norcross, GA (US)

(73) Assignee: Foundation Technologies, Inc., Tucker, GA (US)

( * ) Notice: Subject to any disclaimer, the term of this patent is extended or adjusted under 35 U.S.C. 154(b) by 0 days.

(21) Appl. No.: 09/863,633

(22) Filed: May 21, 2001

(65) Prior Publication Data

US 2002/0031405 A1 Mar. 14, 2002

Related U.S. Application Data

(63) Continuation-in-part of application No. 09/353,760, filed on Jul. 14, 1999, now Pat. No. 6,234,720, which is a continuation-in-part of application No. 08/982,854, filed on Dec. 2, 1997, now Pat. No. 5,931,604.

(60) Provisional application No. 60/032,192, filed on Dec. 2, 1996.

(51) Int. Cl.[7] ..... E02D 7/00; E02D 5/10

(52) U.S. Cl. ..... 405/232; 405/231; 405/256; 405/274

(58) Field of Search ..... 405/229, 231, 405/232, 256, 262, 274, 275, 276, 277–281; 175/65, 66; 173/1

(56) References Cited

U.S. PATENT DOCUMENTS

| | | | | |
|---|---|---|---|---|
| 2,706,498 | A | 4/1955 | Upson | 405/256 X |
| 3,352,120 | A | 11/1967 | Pelzer | 405/256 X |
| 3,963,056 | A | 6/1976 | Shibuya et al. | 405/256 X |
| 4,119,511 | A | 10/1978 | Christenson | 405/232 X |
| 4,157,287 | A | 6/1979 | Christenson | 405/232 X |
| 4,347,019 | A | 8/1982 | Metz | 405/255 |
| 4,721,418 | A | 1/1988 | Queen | 405/231 |
| 4,818,148 | A | 4/1989 | Takeda et al. | 405/231 X |
| 5,145,284 | A | 9/1992 | Hulett et al. | 405/231 X |
| 5,213,166 | A | 5/1993 | Watanabe et al. | 173/1 |
| 5,226,751 | A | 7/1993 | Doleshal | 405/211.1 |
| 5,333,971 | A | 8/1994 | Lewis | 405/281 |
| 5,763,047 | A | 6/1998 | Green | 405/274 X |
| 5,931,604 | A | 8/1999 | Queen | 405/232 |
| 6,234,720 | B1 | 5/2001 | Queen | 405/232 |

OTHER PUBLICATIONS

Proceedings International Conference on Design and Constructions of Deep Foundations, vol. II, Sessions 1 through 4, Dec., 1994.

*Primary Examiner*—Robert E. Pezzuto
(74) *Attorney, Agent, or Firm*—Thomas, Kayden, Horstemeyer & Risley

(57) ABSTRACT

A preferred embodiment of the reduced skin friction bore casing is particularly suited for driving into, and removal from, soils. Preferably the bore casing is composed of a material such as steel, and includes both an exterior and interior surface that are substantially concentric about a longitudinal axis. A friction reduction coating is applied to portions of both the exterior and interior surfaces with enough strength and abrasion resistance to withstand abrasion forces applied to the bore casing during driving operations into the soils as well as extraction when required.

45 Claims, 4 Drawing Sheets

REDUCED SKIN FRICTION BORE CASING

CROSS REFERENCE TO RELATED APPLICATIONS

This application is a Continuation-In-Part Application claiming the benefit of and priority to U.S. application Ser. No. 09/353,760, filed on Jul. 14, 1999, now U.S. Pat. No. 6,234,720. U.S. application Ser. No. 09/353,760 claims the benefit and is a continuation-in-part of and priority to U.S. application Ser. No. 08/982,854, filed on Dec. 2, 1997, now U.S. Pat. No. 5,931,604, which claims the benefit of U.S. Provisional Application Ser. No. 60/032,192, filed on Dec. 2, 1996.

All of the above are incorporated herein by reference.

BACKGROUND OF THE INVENTION

1. Field of the Invention

The present invention generally relates to bore casings which are driven through soils to form or help form structural supports or throughways. More specifically, the present invention relates to a reduced skin friction bore casing for reducing the frictional forces applied to the bore casing by soils and other foundation materials.

2. Description of the Related Art

Deep foundations are utilized to support structures such as, but not limited to, buildings and bridges where near surface in-place soils do not have adequate strength to support the anticipated structural loads. The present invention relates to bore casings generally utilized in the foundation construction industry, which may be driven, pushed, drilled, or otherwise forced into soils and then used to help construct piles or caissons. Quite often these piles are driven through soft compressible soils into hard underlying soils, partially weathered rock, or rock. The support of the piles is provided by these underlying hard materials.

Bore casings may be used for both temporary and permanent applications. Permanent applications refer to those instances where the bore casing is driven, pushed, or drilled into the soils, and the bore casing is left in place as either a portion of the support structure, or possibly a throughway as would be used to house cabling, utility piping, etc. Temporary applications refer to those instances where the bore casing is driven, pushed, or drilled into the soil, the soil present inside the bore casing is excavated, and fluid concrete or another suitable material is introduced to the interior of the bore casing for forming a pile or caisson. Prior to the concrete completely solidifying, the bore casing is removed, leaving the concrete pile behind as a structural element. Temporary and permanent applications for bore casings pose unique sets of problems.

Typically, the bore casings used for permanent applications are of relatively small diameter although it may be desirable to leave a large diameter bore casing in the soil as a portion of a support structure as well. The bore casing is usually driven through compressible soils to a sufficient depth so that the downwardly driven end of the bore casing penetrates harder underlying materials to a specified depth or until refusal is achieved. Typically, significant support of the piles is provided by these underlying harder materials.

When used in permanent applications, the bore casing will be subject to a downward frictional force on the bore casing that is a function of the horizontal stress applied to the bore casing by the soil and the coefficient of friction of the bore casing's exterior surface relative to the soil. This downward force can result in failure of a structural support due to an unexpected downward movement of the bore casing enclosed pile or caisson, or increase the time required to install the pile or caisson.

For many years, departments of transportation, structural engineers and geotechnical engineers have struggled with the problem of how to reduce downward frictional forces imposed upon piles. Many costly measures have been implemented to address this problem, including: delaying construction to allow underlying soils to consolidate and settle; utilizing support structures designed for an increased load capacity; and pre-drilling a hole and re-filling the hole with a lubricating material or pea gravel. These methods result in considerable increased construction costs.

In cases calling for delaying construction to allow underlying soils to settle, both workers and machinery can remain idle for extended periods of time, thereby driving up costs. Lubricants and other substances placed in pre-drilled holes lend themselves to environmental concerns.

In cases in which the anticipated structural load on the support structure is increased to account for a downward frictional force, a higher capacity support structure is required. This requires driving the bore casing farther into the harder consistency soils, thereby requiring an increase in bore casing length and an increase in the capacity of the driving hammer capable of driving a bore casing to a higher criteria. In some cases, these requirements increase the cost of constructing the support structure and the length of time for support structure installation and may require an increased cross sectional area of the bore casing to allow for the higher capacity.

When used for temporary applications, other frictional forces come into play. Typically,. the bore casing will be driven, pushed, or inserted in a pre-drilled hole. Once in place, unless the hole has been pre-drilled, the soil present in the internal space of the bore casing is removed through drilling. After a void has been created to the desired depth, fluid concrete or another suitable material is poured into the void. Prior to the final solidification of the concrete to form the support structure, the bore casing is removed for use in the formation of other support structures. As would be expected, reduction of insertion and extraction forces will reduce the time and effort required to create the support structure.

Therefore, there is a need to reduce the friction forces between the bore casing and the soils and construction materials contacting both the interior and exterior surfaces of the bore casing during insertion. Also of interest is reducing the upward friction forces exerted by the soil on the inner surface of the bore casing during excavation of the internal volume of the bore casing. Importantly, reduction of downward frictional forces during extraction is desired. This is the point in the process when the greatest forces will probably be encountered. It is possible that the downward frictional forces exerted by the soil on the exterior of the bore casing in combination with the downward frictional forces exerted by the hardening concrete on the inner surface of the bore casing can make removal of the bore casing by standard methods problematic. In this case, the bore casing is either left in position or extracted using great time and effort, and potentially severely damaging the support structure as a result. Even if the bore casing is eventually removed leaving the support structure in place, excessive friction with the concrete support structure could cause the support structure to be partially raised with the bore casing. This can lead to voids in the support structure as well as the thinning (or necking) of the support structure and weaken it greatly. If the bore casing is left in the soil, this could cause later structural problems as the frictional calculations for the support will have been completed using a frictional coefficient of concrete, rather than that of the bore casing.

Therefore, there is a need for improved bore casings which address these and other shortcomings of the prior art.

BRIEF SUMMARY OF THE INVENTION

Briefly described, the present invention relates to a reduced skin friction bore casing which reduces the frictional forces applied to the pile by soils and construction materials encountered during insertion and extraction operations, as well as by the settling of compressible soils surrounding the bore casing after the bore casing has been driven into the soil. A preferred embodiment of the reduced skin friction bore casing is particularly suited for driving into, and removal from, soils. Preferably the bore casing is composed of a material such as steel, and includes both an exterior and interior surface that are substantially concentric about a longitudinal axis. A friction reduction coating is applied and adhered to portions of the exterior and/or interior surfaces with enough strength and abrasion resistance to withstand abrasion forces applied to the bore casing during driving operations into the soils as well as extraction when required.

In accordance with another aspect of the present invention, a preferred method includes the steps of: (1) providing a bore casing of constant size and shape along a longitudinal axis, having an interior surface and an exterior surface; (2) adhering a friction reduction coating to the exterior surface with enough strength and abrasion resistance to withstand the abrasion forces applied to the pile during insertion operations into the soil; and (3) and inserting the bore casing into the soil. In those applications where the bore casing is not to remain in the soil as a part of a support structure, the method can further include the steps of: (1) adhering a friction reduction coating to the interior surface with enough strength and abrasion resistance to withstand the abrasion forces applied to the pile or caisson during insertion and extraction operations; (2) excavating the soil from the inner volume of the bore casing; (3) filling the inner volume of the bore casing with concrete; and (4) extracting the bore casing from the soil.

Other objects, features and advantages of the present invention will become apparent upon reading the following specification, when taken in conjunction with the accompanying drawings.

BRIEF DESCRIPTION OF THE SEVERAL VIEWS OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE PREFERRED EMBODIMENT

Figure 1:
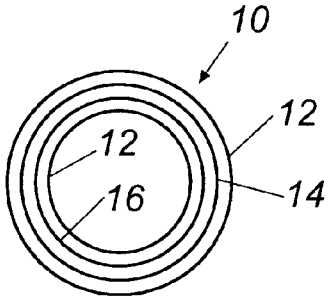
FIG. 1 illustrates a cross-sectional view of a preferred embodiment of the reduced skin friction bore casing of the present invention, taken transverse to the longitudinal axis of the bore casing.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

As shown in FIG. 1, a friction reduction coating 12 is applied to both the exterior surface 14 and the interior surface 16 of the bore casing 10. Typically, the bore casings 10 are made of steel. The friction reduction coating 12 is a compound, such as an epoxy, polymer, urethane, or copolymer, potentially containing silicone, graphite, etc., and possessing sufficient strength and abrasion resistance to withstand the abrasion forces applied to the bore casing 10 during both driving and extracting operations, depending on how the bore casing 10 is being used. The friction reduction coating 12 also has a very low coefficient of friction relative to the soils and other construction materials contacting the bore casings 10. The friction reduction coating 12 can be applied at either the point of manufacture or the construction site, using such methods as spray coating or brush coating.

Figure 2:
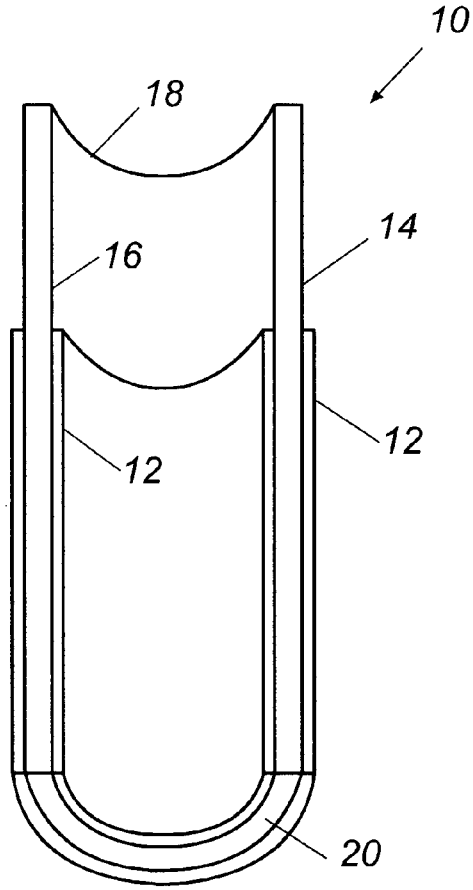
FIG. 2 illustrates a bottom perspective view of a cross-sectional view taken along the longitudinal axis of a bore casing as shown in FIG. 1.

As shown in FIG. 2, each of the bore casings 10 is formed as a generally elongated member possessing a longitudinal axis, exterior and interior surfaces, 14 and 16 respectively, that are substantially concentric to the longitudinal axis, and top and bottom edges, 18 and 20 respectively, that are substantially transverse to the longitudinal axis. In FIG. 2, the friction reduction coating 12 is adhered to both the exterior and interior surfaces 14, 16. Note that all embodiments of the bore casings 10 do not require, nor is it desired to have, the friction reduction coating 12 on both the exterior and interior surfaces 14, 16, as will be discussed. As well, the portions of the exterior and interior surfaces 14, 16 shown with the friction reduction coating 12 is merely illustrative of the fact that neither the exterior surface 14 nor interior surface 16 need to have the friction reduction coating 12 adhered to the entire surface. Rather, the portions coated will depend on the particular use of the bore casing 1O, or possibly the composition of the soils encountered.

Figure 3A:
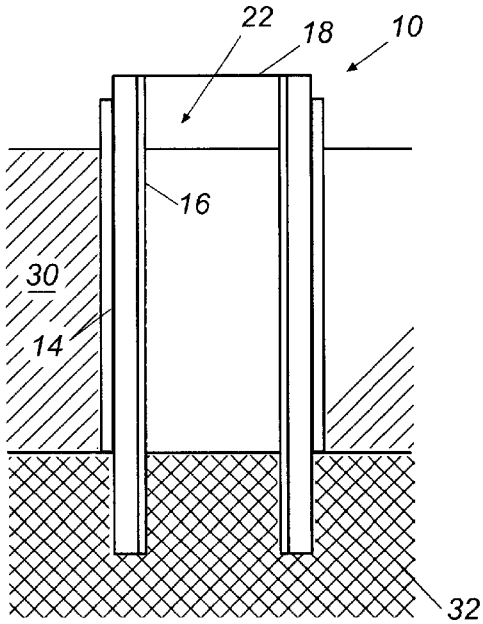
FIGS. 3A–3C are partially cut-away, side elevations of a bore casing of the present invention shown driven through compressive soil into relatively harder, cohesive soil.
Figure 3B:
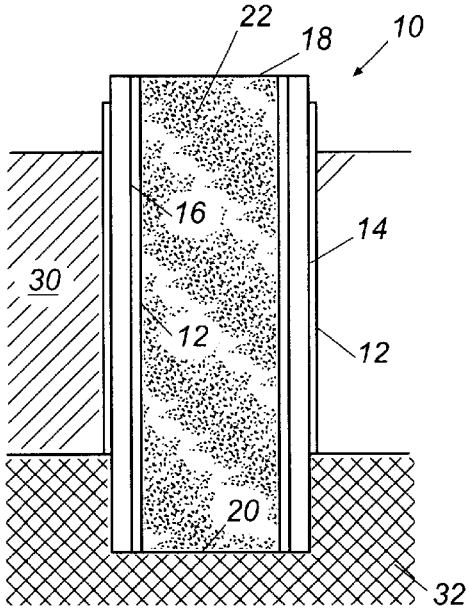
Figure 3C:
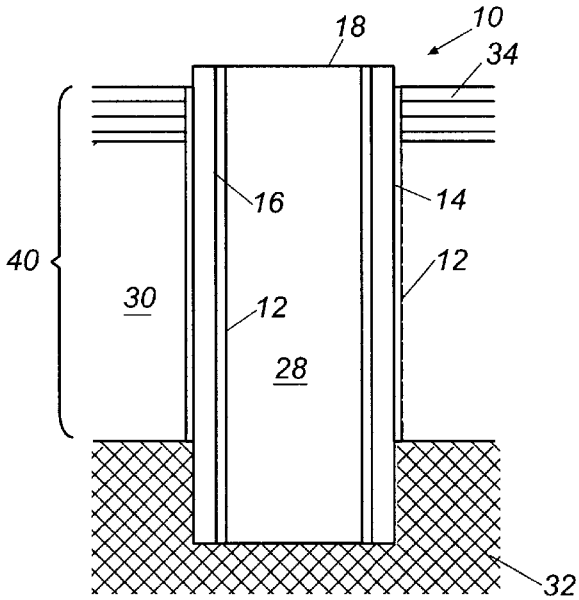
Figure 5:
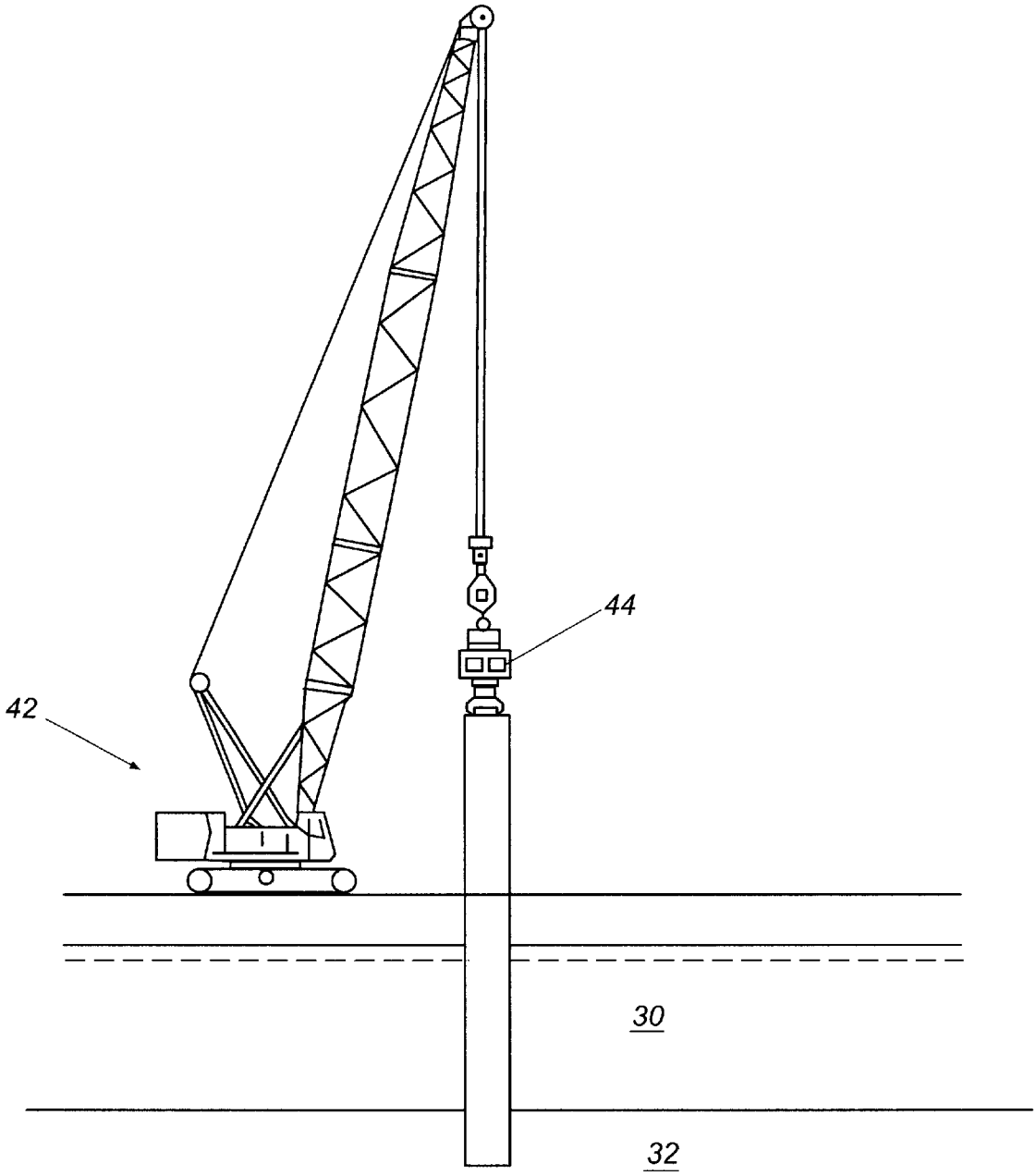
FIG. 5 is an illustration of a crane driving a bore casing of the present invention through compressive soil into relatively harder, cohesive soil.

As shown in FIGS. 3A–3C, a bore casing 10 is driven into soil in a conventional manner, typically with its longitudinal axis being maintained in a substantially vertical, upright orientation. However, bore casings 10 can be used in any orientation, including diagonally or even horizontally. The bore casings 10 commonly are driven through an upper layer of relatively compressible soil 30 and into relatively harder, cohesive soil 32 therebelow, with the bore casings 10 being driven to a sufficient depth so that the cohesive soil 32 provides stability to the bore casing 10. As shown in FIG. 5, a crane 42 is using a vibratory driver 44 to drive a bore casing 10 through the compressible soil 30 and into the cohesive soil 32.

Depending upon the particular application, compacted fill 34 is added on top of the compressible soil 30, such as for raising ground level. Detrimentally, the added weight of the compacted fill 34 applies stress to the underlying compressible soil 30 and the underlying cohesive soil 32. Typically, the cohesive soil 32 is able to support this stress without compressing significantly; however, oftentimes, the compressible soil 30 compresses under the newly applied stress which causes the compacted fill 34 and the compressible soil 30 to settle relative to the bore casings 10, which are supported by the relatively hard, cohesive soil 32 below. This results in a downward movement of the compacted fill 34 and compressible soil 30 relative to the bore casings 10, and allows the settling soils 30 and 34, which are in physical contact with the bore casings 10, to apply a downward force to the bore casings 10. Since, however, the friction reduction coating 12 has a low coefficient of friction relative to the soils 30 and 34, the downward force caused by these settling soils 30, 34 contacting the external surface of the bore casing 10 is reduced.

The friction reduction coating 12 need only be applied to a compressible soil contact portion 40 of the bore casing 10. In FIG. 3C, the portion of the bore casing 10 that is expected to have soils settling relative thereto after the bore casing 10 has been driven incorporates the coating 12. However, it is not necessary to coat the precise compressible soil contact portion 40 in that partially coating the compressible soil contact portion 40 can still be adequate to achieve the desired reduction in friction.

The location of the compressible soil contact portion 40 of the bore casing 10 is determined by measuring the depth of the soft compressible soils 30 at the location for bore casing 10 placement by soil testing in a known manner. Once the depth of the compressible soils 30 is determined, the bore casing 10 is marked at a length which corresponds to the bottom of the compressible soils 30 so that when the bore casing 10 is driven, the mark substantially aligns with the bottom of the compressible soils 30. Starting at this mark and measuring a distance corresponding to the compressible soil 30 depth toward the top of the bore casing 10, a second mark is placed on the bore casing 10. The area between these two marks represents the soft soil contact portion 40 of the bore casing 10. Further, if compacted fill 34 is to be used, the second mark may be moved up the bore casing 10 to adjust the soft soil contact portion 40 accordingly.

Note that after the bore casing 10 has been driven into the soil, the internal volume 22 of the bore casing 10 contains the soils into which the bore casing 10 has been driven. These soils must be removed so the pile 28 can eventually be formed in the internal volume 22. This is commonly achieved by augering the soils out of the bore casing 10, and is commonly referred to as a "drilled shaft." As the soils are urged out of the bore casing 10, the soils contact the inner surface 16 and create upward frictional forces. It is desirable to minimize these forces in that they may tend to urge the bore casing 10 upward, and out of position. Therefore, it is advantageous to adhere the friction reduction coating 12 to the interior surface 16, thereby reducing these forces. Once again, although the soils will make contact with the entire length of the interior surface 16 as they are removed, sufficient reduction of friction forces can be achieved without adhering the friction reduction coating 12 to the entire interior surface 16.

Figure 4:
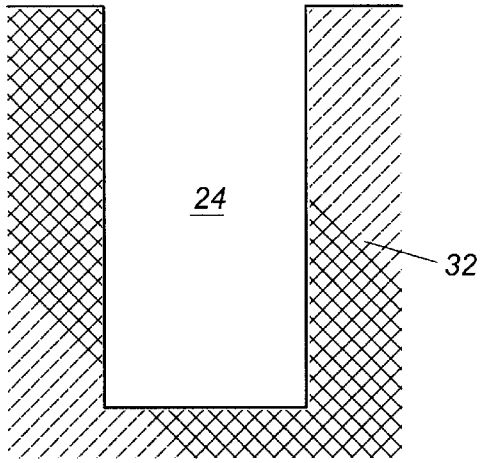
FIG. 4 is a partially cut-away, side elevation of a pre-drilled void into which a bore casing of the present invention can be inserted.

Removal of soils from the internal volume 22 is not always necessary. As shown in FIG. 4, if desired, the void 24 into which the bore casing 10 is inserted may be pre-drilled. However, this is generally only done where cohesive soils 32 are encountered because pre-drilled holes are susceptible to caving and soil and rock deformation, thereby hampering bore casing 10 insertion. Also, bore casings 10 can be capped (not shown) on the bottom edge 20 prior to driving, thereby preventing soils from entering the internal volume 22 during drilling. In these instances, because the step of excavating soils from the internal volume 22 is not required, there is no need to adhere the friction reduction coating 12 to the interior surface 16 as there will be no upward frictional forces exerted on the interior surface 16.

As shown in FIG. 3C, once the internal volume 22 has been evacuated, fluid concrete, or another such material is used to create the pile 28. Once the pile 28 has formed, the pile 28 in combination with the bore casing 10 will form a structural support. When the bore casing 10 remains in the soil with the pile 28, it is referred to as a permanent use of the bore casing 10. As well, the bore casing 10 may serve as the structural support, without a pile 28 being formed therein. Most frequently, a pile 28 is formed and the bore casing 10 is removed for later use, as discussed below.

Additionally, the friction reduction coating 12 protects bore casings 10 against corrosion by providing an additional physical moisture barrier between soil moisture, i.e. ground water, and the bore casing 10.

As shown in FIGS. 6A–6E, bore casings 10 may be used in a temporary fashion when forming support structures. In accordance with another aspect of the present invention, a bore casing 10 is driven into the soil. Because the bore casing 10 will eventually be extracted from the soil, downward frictional forces due to settling soils are no longer of concern. However, reduction of frictional forces during driving operations is still important and as such, both the exterior and interior surfaces 14, 16 have received the friction reduction coating 12. Note that only the portion of the exterior surface 14 to contact the soils has received the friction reduction coating 12. However, this is not necessary. The entire exterior surface 14, or even less than the portion contacting the soils could have had the friction reduction coating 12 adhered thereto, so long as adequate reduction of the frictional forces is achieved.

Note that as in the embodiment of the permanent use of the bore casing 10 shown in FIGS. 3A–3C, soils must be excavated from the internal volume 22 of the bore casing 10. Therefore, the entire interior surface 16 of the bore casing 10 has the friction reduction coating 12 adhered thereto. Even if the void 24 for the bore casing 10 had been pre-drilled, thereby negating the need to excavate soils from the internal volume 22, it is still desirable to have a friction reduction coating 12 on the interior surface 16 of the bore casing 10 when the bore casing 10 is used in a temporary fashion, as discussed below. Note that the void 24 created in FIG. 5B extends beyond the bottom edge 20 of the bore casing 10, thereby showing the length of the pile 28 is not limited by the length of the bore casing 10.

Figure 6A:
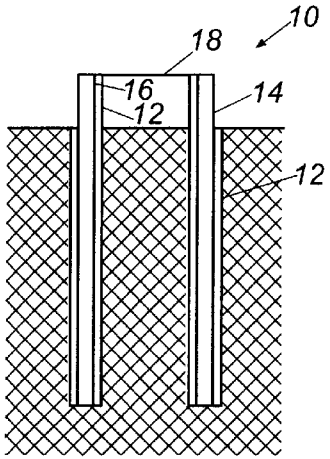
FIGS. 6A–6E are partially cut-away, side elevations of a bore casing of the present invention as used to create a pile.
Figure 6B:
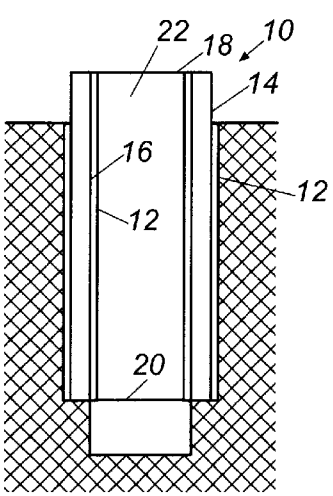
Figure 6C:
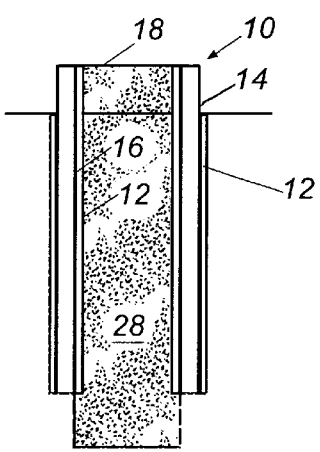
Figure 6D:
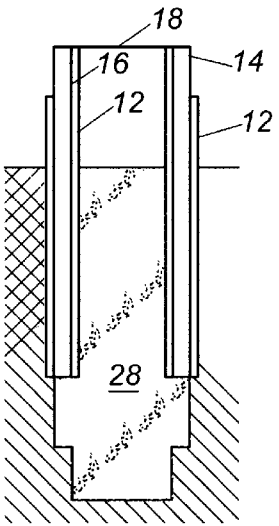
Figure 6E:
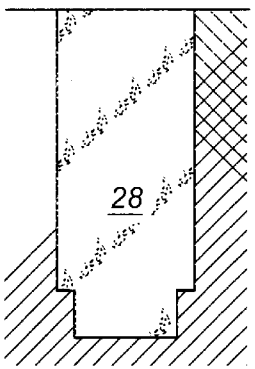

As shown in FIG. 6C, fluid concrete is once again used to form a pile 28. Although not shown, rebar support cages are often inserted into the fluid concrete for structural support before the concrete solidifies. Also before the concrete solidifies, the bore casing 10 is extracted from the soil. The time for extraction of the bore casing 10 is dependent on a number of variables, such as the size of the pile 28, the soil composition in the vicinity of the pile 28, and existing soil hydration conditions. Once the proper time is determined, the bore casing 10 is removed, leaving the concrete to fill the annular void left behind as the bore casing 10 is removed.

As previously discussed, if the fluid concrete is allowed to solidify beyond the desired point, removal of the bore casing 10 without damaging the pile 28 may become problematic. Worst case, it may be necessary to start the process over if the pile 28 is severely damaged. Of course, this requires great time, effort, and expense. The friction reduction coating 12 adhered to the interior surface 16 of the bore casing 10 reduces the downward frictional forces caused by the curing of the concrete acting on the interior surface 16. The friction reduction coating 12 adhered to the exterior surface 14 reduces downward frictional forces due to the soils. Therefore, the bore casing 10 is more easily extracted over a greater period of time. This lessons the chances that the pile 28 will be damaged because there is more leeway allowed for calculating when to extract the bore casing 10. The friction reduction coating 12 promotes efficient driving of the bore casings 10 into and removal of the bore casings 10 from soil, thereby improving the efficiency of the aforementioned method.

As well, once the bore casing has been removed from the soil, the friction reduction coating 12 offers a number of advantages over untreated bore casings 10. Quite often, after a bore casing 10 has been removed from the soil, the bore casing 10 is stored either on the construction site for later use or taken to a storage yard. If the exterior surface 14 and interior surface 16 are not properly cleaned, any concrete or soils that may be present on the bore casing 10 from prior use can solidify and thereby cause increased frictional forces with the soils and concrete during the next use. The friction reduction coating 12 not only reduces the amount of residual concrete and soil that will remain on the surfaces of the bore casing 10 after use, but because the friction reduction coating 12 has a very low coefficient of friction, it also creates a slip plane between the bore casing surfaces 14, 16 and the soils and concrete. This allows any residual soil and/or concrete to be more easily removed over a longer period of time. As well, the friction reduction coating 12 acts as a corrosion inhibiting surface, thereby reducing the amount of corrosion that can accumulate on the surfaces 14, 16 of the bore casing 10 during storage. Reduced corrosion of the bore casing surfaces 14, 16 means reduced frictional forces during subsequent uses of the bore casing 10.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A reduced skin friction bore casing for driving into soils, said reduced skin friction bore casing comprising:

said bore casing having a longitudinal axis, a first end and a second end, an exterior surface and an interior surface, said exterior and said interior surfaces being cylindrical and defined by said first and said second ends, said exterior surface and said interior surface being concentric about said longitudinal axis; and a friction reduction coating adhered to a first portion of said exterior surface with enough strength and abrasion resistance to withstand abrasion forces applied to said bore casing during driving operations into the soils.

2. The bore casing of claim 1, wherein said bore casing is made of steel.

3. The bore casing of claim 1, wherein said friction reduction coating is adhered to a portion of said interior surface.

4. The bore casing of claim 1, wherein the soils include a compressible soil disposed above a harder soil and said bore casing is configured to extend downwardly through the compressible soil into the harder soil, said first portion extending over the length of said bore casing such that when said bore casing is driven through the compressible soil and into the harder soil, said friction reduction coating contacts the compressible soil into which said bore casing is disposed and decreases the coefficient of friction between said exterior surface of said bore casing and the compressible soil, thereby reducing friction between said exterior surface of said bore casing and the compressible soil adjacent said bore casing when the compressible soil settles downwardly relative to said bore casing.

5. The bore casing of claim 1, wherein the soils include a compressible soil disposed above a harder soil and said bore casing is configured to extend downwardly through the compressible soil into the harder soil, said first portion extending over the length of said bore casing such that when said bore casing is driven through the compressible soil and into the harder soil, said friction reduction coating contacts the compressible soil and/or harder soil into which said bore casing is disposed and decreases the coefficient of friction between said exterior surface of said bore casing and the compressible soil and/or harder soil, thereby reducing friction between said exterior surface of said bore casing and the compressible soil and/or harder soil adjacent said bore casing when the compressible soil settles downwardly relative to said bore casing.

6. The bore casing of claim 5, wherein said friction reduction coating is further adhered to a portion of said interior surface.

7. The bore casing of claim 6, wherein said portion of said interior surface extends over entire said interior surface.

8. The bore casing of claim 6, wherein the soils have been removed from an interior volume of said bore casing such that said interior volume can receive a cementacious material, said portion of said interior surface extending over a length of said bore casing such that when said volume is filled with said cementacious material, said friction reduction coating contacts said cementacious material disposed in said volume.

9. The bore casing of claim 1, wherein said bore casing is configured to extend downward through soils, said first portion extending over a length of said bore casing such that when said bore casing is driven through the soils, said soil friction reduction coating contacts the soils into which said bore casing is disposed and decreases the coefficient of friction between said exterior surface of said bore casing and the soils.

10. The bore casing of claim 9, wherein the soils have been removed from an interior volume of said bore casing such that said interior volume can receive a cementacious material, said portion of said interior surface extending over a length of said bore casing such that when said volume is filled with said cementacious material, said friction reduction coating contacts said cementacious material disposed in said volume.

11. The bore casing of claim 1, wherein said friction reduction coating is adhered to entire said exterior surface and entire said inner surface.

12. The bore casing of claim 1, wherein said first portion extends over entire said exterior surface.

13. A method of reducing skin friction on a bore casing configured for insertion into soils, comprising the steps of:

providing a bore casing of constant size and shape along a longitudinal axis, having an interior surface and an exterior surface;

determining a portion of said exterior surface to contact the soils;

adhering a friction reduction coating to said portion of said exterior surface with enough strength and abrasion resistance to withstand the abrasion forces applied to the pile during insertion operations into the soil; and inserting said bore casing into the soil.

14. The method of claim 13, wherein the step of inserting further includes hammering driving, drilling and vibrational driving.

15. The method of claim 13, wherein the soils have a compressible soil layer overlying a harder soil layer, and the step of determining said portion of said exterior surface further includes:

determining the depth of the compressible soil layer;

determining a portion of said exterior surface to contact the compressible soil layer; and wherein the friction reduction coating is adhered to said portion of said exterior surface to contact the compressible soil layer after the pile has been inserted into the soils.

16. The method of claim 13, wherein the step of adhering said friction reduction coating further includes adhering said friction reduction coating to a portion of said interior surface.

17. The method of claim 16, wherein said portion of said interior surface includes entire said interior surface.

18. The method of claim 15, wherein said portion of said interior surface coincides with said portion of said exterior surface.

19. The method of claim 18, further comprising the steps of:

excavating the soils from an inside volume of said bore casing; and filling said inside volume with a cementacious material.

20. The method of claim 19, further including the step of extracting said bore casing from the soils prior to said cementacious material attaining solid form.

21. The method of claim 19, wherein the step of excavating the soils further includes excavating soils disposed below said bore casing.

22. The method of claim 17, wherein said portion of said exterior surface further includes the entire said exterior surface.

23. The method of claim 20, wherein said step of extracting said bore casing is performed with a vibratory driver.

24. A reduced skin friction bore casing for driving into soils, said bore casing comprising:

said bore casing having a longitudinal axis, a first end and a second end, an exterior surface and an interior surface, said exterior surface and said interior surface being cylindrical and defined by said first end and said second end, said exterior surface and said interior surface being concentric about said longitudinal axis; and a friction reduction coating applied to entire said exterior surface.

25. The bore casing of claim 24, wherein said friction reduction coating is applied to entire said inner surface.

26. The bore casing of claim 24, wherein said friction reduction coating adheres to said exterior surface with enough strength and abrasion resistance to withstand abrasion forces applied to said bore casing during driving operations into the soils.

27. The bore casing of claim 25, wherein said friction reduction coating adheres to said exterior surface and said interior surface with enough strength and abrasion resistance to withstand abrasion forces applied to said bore casing during driving operations into the soils.

28. The bore casing of claim 27, wherein said bore casing is made of steel.

29. A method of reducing skin friction on a bore casing configured for insertion into soils, comprising the steps of:

providing a bore casing of constant size and shape along a longitudinal axis, having an exterior surface and an interior surface; and applying a friction reduction coating to a portion of said exterior surface and a portion of said interior surface.

30. The method of claim 29, wherein said portion of said exterior surface includes entire said exterior surface.

31. The method of claim 30, wherein said portion of said interior surface includes entire said interior surface.

32. The method of claim 31, wherein said friction reduction coating adheres to said exterior surface and said interior surface with enough strength and abrasion resistance to withstand the abrasion forces applied to said bore casing during insertion operations into the soils.

33. The method of claim 29, wherein the step of applying a friction reduction coating includes either spray coating or brush coating.

34. The method of claim 30, further comprising the steps of:

inserting said bore casing into the soils;

excavating the soils from an inside volume of said bore casing; and filling said inside volume of said bore casing with fluid concrete.

35. The method of claim 31, further comprising the steps of:

inserting said bore casing into the soils;

excavating the soils from an inside volume of said bore casing;

filling said inside volume of said bore casing with fluid concrete: and extracting said bore casing from said soils.

36. A reduced skin friction bore casing for driving into soils, said reduced skin friction bore casing comprising:

said bore casing having a longitudinal axis, a first end and a second end, an exterior surface and an interior surface, said exterior and said interior surfaces being cylindrical and defined by said first and said second ends, said exterior surface and said interior surface being concentric about said longitudinal axis; and a friction reduction coating adhered to a portion of said exterior surface with enough strength and abrasion resistance to withstand abrasion forces applied to said bore casing during driving operations into the soils, said friction reduction coating being a corrosion inhibitor.

37. The bore casing of claim 36, wherein said friction reduction coating is adhered to a portion of said interior surface.

38. The bore casing of claim 37, wherein said bore casing is made of steel.

39. The bore casing of claim 38, wherein said portions of said interior and said exterior surfaces includes the entire said interior and exterior surfaces.

40. A method of reducing skin friction on a bore casing configured for insertion into soils, comprising the steps of:

providing a bore casing of constant size and shape along a longitudinal axis, having an exterior surface and an interior surface;

applying a friction reduction coating to a portion of said exterior surface and a portion of said interior surface, wherein said friction reduction coating adheres to said exterior surface and said interior surface with enough strength and abrasion resistance to withstand the abrasion forces applied to said bore casing during insertion operations into the soils;

inserting said bore casing into the soils;

filling said inside volume of said bore casing with fluid concrete; and extracting said bore casing from said soils.

41. The method of claim 40, wherein said portion of said exterior surface includes entire said exterior surface.

42. The method of claim 40, wherein said portion of said interior surface includes entire said interior surface.

43. A method of installing concrete piers in the ground, comprising the steps of:

providing a bore casing of constant size and shape along a longitudinal axis, having an exterior surface and an interior surface;

adhering a friction reduction coating to at least a portion of the interior surface that is to receive liquid concrete, wherein the friction reduction coating adheres to the interior surface with enough strength and abrasion resistance to withstand the abrasion forces applied to the interior surface during withdrawal of the casing from about wet concrete;

inserting the bore casing into the ground;

filling at least a portion of the inside volume of the bore casing with concrete in liquid form;

extracting said bore casing from the ground and about the liquid concrete with the friction reduction coating providing a slip plane between the conduit and the liquid concrete.

44. The method of claim 43, and further including the step of after the bore casing has been withdrawn from about the liquid concrete and before the liquid concrete dries on the inner surface of the bore casing, washing from the inner surface of the bore casing any liquid concrete present on the inner surface of the bore casing.

45. The method of claim 43, wherein the portion of the interior surface includes the entire interior surface.

* * * * *